US010862237B2

(12) United States Patent
Jin et al.

(10) Patent No.: US 10,862,237 B2
(45) Date of Patent: Dec. 8, 2020

(54) ELECTRICAL CONNECTOR WITH HOUSING HAVING A LANCE ENGAGING A BOX TERMINAL

(71) Applicant: Yazaki Corporation, Tokyo (JP)

(72) Inventors: Dacheng Jin, Shizuoka (JP); Naokazu Nagasaka, Shizuoka (JP); Atsuhito Saito, Shizuoka (JP); Shingo Chiba, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/417,734

(22) Filed: May 21, 2019

(65) Prior Publication Data

US 2019/0363473 A1 Nov. 28, 2019

(30) Foreign Application Priority Data

May 23, 2018 (JP) ..... 2018-099091

(51) Int. Cl.

| | |
|---|---|
| ***H01R 13/424*** | (2006.01) |
| ***H01R 4/18*** | (2006.01) |
| ***H01R 13/11*** | (2006.01) |
| *H01R 13/506* | (2006.01) |
| *H01R 13/422* | (2006.01) |

(Continued)

(52) U.S. Cl.

CPC ..... *H01R 13/424* (2013.01); *H01R 4/185* (2013.01); *H01R 13/11* (2013.01); *H01R 13/04* (2013.01); *H01R 13/113* (2013.01); *H01R 13/422* (2013.01); *H01R 13/4223* (2013.01); *H01R 13/4364* (2013.01); *H01R 13/506* (2013.01); *H01R 13/62927* (2013.01)

(58) Field of Classification Search

CPC ..... H01R 13/4223; H01R 13/4364; H01R 13/506; H01R 13/422; H01R 13/113; H01R 13/62927; H01R 13/04; H01R 13/424; H01R 4/185; H01R 13/11

USPC ..... 439/752, 871, 595

See application file for complete search history.

(56) References Cited

U.S. PATENT DOCUMENTS 7,014,505 B1 * 3/2006 Tanaka ..... H01R 13/4362 439/595

2003/0228795 A1 * 12/2003 Ichida ..... H01R 43/22 439/595

(Continued)

FOREIGN PATENT DOCUMENTS

EP 1 369 959 A1 12/2003

JP 200414305 A 1/2004

(Continued)

*Primary Examiner* — Abdullah A Riyami

*Assistant Examiner* — Justin M Kratt

(74) *Attorney, Agent, or Firm* — Sughrue Mion, PLLC

(57) ABSTRACT

In a terminal accommodating chamber provided in a housing of a connector, a terminal to which an electric wire is connected is accommodated. The terminal is held by the engagement between a locking face of a lance molded in a terminal accommodating chamber and a locking target face provided in a box portion of the terminal. The locking target face is provided in a front ceiling plate molded by notching a ceiling plate of the box portion in a width direction to reach a facing plate outer face. The locking face and the locking target face are engaged with each other within a range wider than a facing plate inner face width of the facing plate.

5 Claims, 9 Drawing Sheets

(51) Int. Cl.

| | |
|---|---|
| *H01R 13/04* | (2006.01) |
| *H01R 13/436* | (2006.01) |
| *H01R 13/629* | (2006.01) |

(56) References Cited

U.S. PATENT DOCUMENTS

| | | | |
|---|---|---|---|
| 2003/0228796 | A1 | 12/2003 | Nankou et al. |
| 2006/0063427 | A1 | 3/2006 | Tanaka et al. |
| 2014/0017929 | A1 | 1/2014 | Nagasaka et al. |

FOREIGN PATENT DOCUMENTS

| | | | |
|---|---|---|---|
| JP | 2005259363 | A | 9/2005 |
| JP | 2015-079643 | A | 4/2015 |

* cited by examiner

ELECTRICAL CONNECTOR WITH HOUSING HAVING A LANCE ENGAGING A BOX TERMINAL

CROSS-REFERENCE TO RELATED APPLICATION(S)

The present application claims priority to and incorporates by reference the entire contents of Japanese Patent Application No. 2018-099091 filed in Japan on May 23, 2018.

BACKGROUND OF THE INVENTION

1. Field of the Invention

The present invention relates to an engagement structure between a terminal accommodated in a terminal accommodating chamber provided in a housing and a lance.

2. Description of the Related Art

In related art, a connector in which a terminal, to which an electric wire is connected, is inserted into a terminal accommodating chamber (a cavity) provided in a housing of a connector, an elastically deformable lance (a resilient locking piece) molded in the terminal accommodating chamber is engaged with the terminal, and the terminal is accommodated in the terminal accommodating chamber has been known (for example, Japanese Patent Application Laid-open No. 2015-079643).

In the technique described in Japanese Patent Application Laid-open No. 2015-079643, in a wall portion in which a terminal locking protrusion and a penetration hole are provided in a box-shaped portion of the terminal, the terminal locking protrusion reaches the penetration hole. Further, an end face of the terminal locking protrusion on the penetration hole side engages with the locking unit of the lance. However, the penetration hole is molded in the wall portion, and a connecting wall portion is provided on an end portion side in a lateral direction (a width direction) of the terminal, that is, the connecting wall portion exists. Therefore, a dimension in the lateral direction (the width direction) of the locking unit in the lance is set in consideration of the connecting wall portion, an engaging dimension between the locking unit of the lance and the terminal locking protrusion is narrowed, and an engagement area becomes small. Therefore, when a tensile force is applied to the electric wire connected to the terminal, there is a concern that a sufficient holding force of the terminal due to the lance cannot be secured.

SUMMARY OF THE INVENTION

The present invention has been made in view of the above description and an object thereof is to provide a connector capable of improving the holding force of a terminal accommodated in a terminal accommodating chamber of a housing.

In order to achieve the above mentioned object, a connector according to one aspect of the present invention includes a terminal that is connected to an electric wire; and a housing, wherein the housing has a housing main body, the housing main body has a terminal accommodating chamber, the terminal accommodating chamber has a rectangular cross section in a direction orthogonal to a front-rear direction, the terminal accommodating chamber is molded from a front wall, an upper wall, two facing walls, and a bottom wall, the upper wall and the bottom wall face each other in a vertical direction orthogonal to the front-rear direction, the two facing walls face each other in a width direction orthogonal to the front-rear direction and the vertical direction, the bottom wall has an elastically deformable lance connected at a base portion, the lance has a locking face facing a forward direction side which is an inserting direction of the terminal, the terminal has a box portion and a connecting portion, the box portion has a rectangular cross section in a direction orthogonal to the front-rear direction, the box portion has a ceiling plate, two facing plates, and a bottom plate, the ceiling plate and the bottom plate face each other in the vertical direction, the two facing plates face each other in the width direction, the ceiling plate has at least a front ceiling plate molded by a notch reaching each facing plate outer face of the two facing plates, the front ceiling plate has a locking target face facing a rearward direction side which is a detaching direction of the terminal, and in a state in which the terminal is accommodated in the terminal accommodating chamber, the locking face engages with the locking target face in a range wider than both facing plate inner face widths of the two facing plates in the width direction.

According to another aspect of the present invention, in the connector, it is possible to configure that the locking target face of the front ceiling plate has a horizontal locking target face portion, and a convex locking target face portion which protrudes in the vertical direction by molding of a convex portion reaching the locking target face on the front ceiling plate in the front-rear direction.

According to still another aspect of the present invention, in the connector, it is possible to configure that the front ceiling plate has a front convex portion which is connected to one facing plate of the two facing plates in the width direction and protrudes from the other facing plate side toward the bottom plate side, the other facing plate has a front concave portion which is notched from the ceiling plate side toward the bottom plate side, and the front convex portion and the front concave portion engage with each other.

According to still another aspect of the present invention, in the connector, it is possible to configure that the two facing walls of the terminal accommodating chamber have grooves recessed outward in the width direction from each facing wall inner face, and the grooves are molded in a portion facing a lance side face along the front-rear direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a connector according to the present invention will be described in detail below with reference to the drawings. It should be noted that the invention is not limited by the embodiment.

Embodiment

Figure 1:
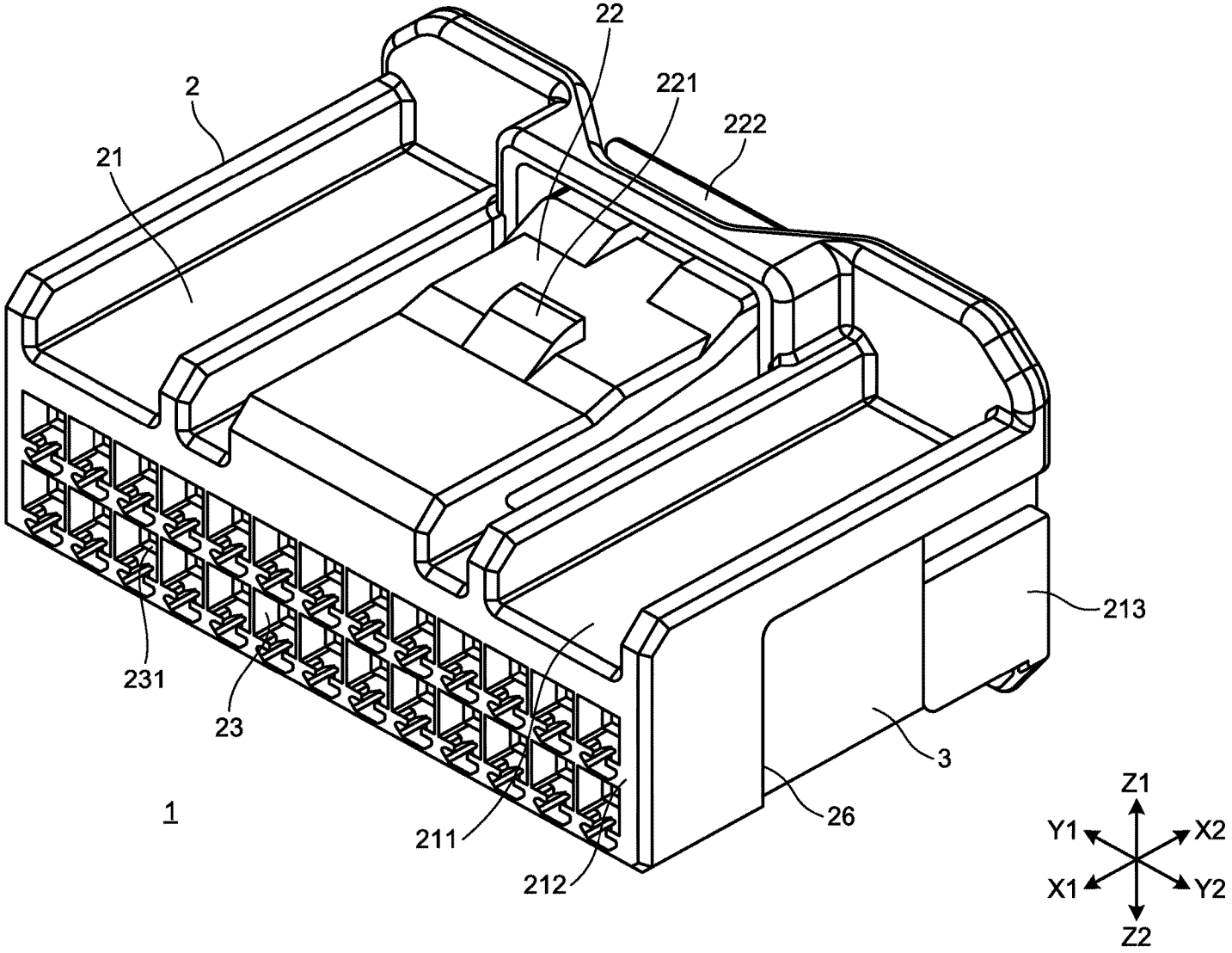
FIG. 1 is a perspective view illustrating a connector according to an embodiment of the present invention.
Figure 2:
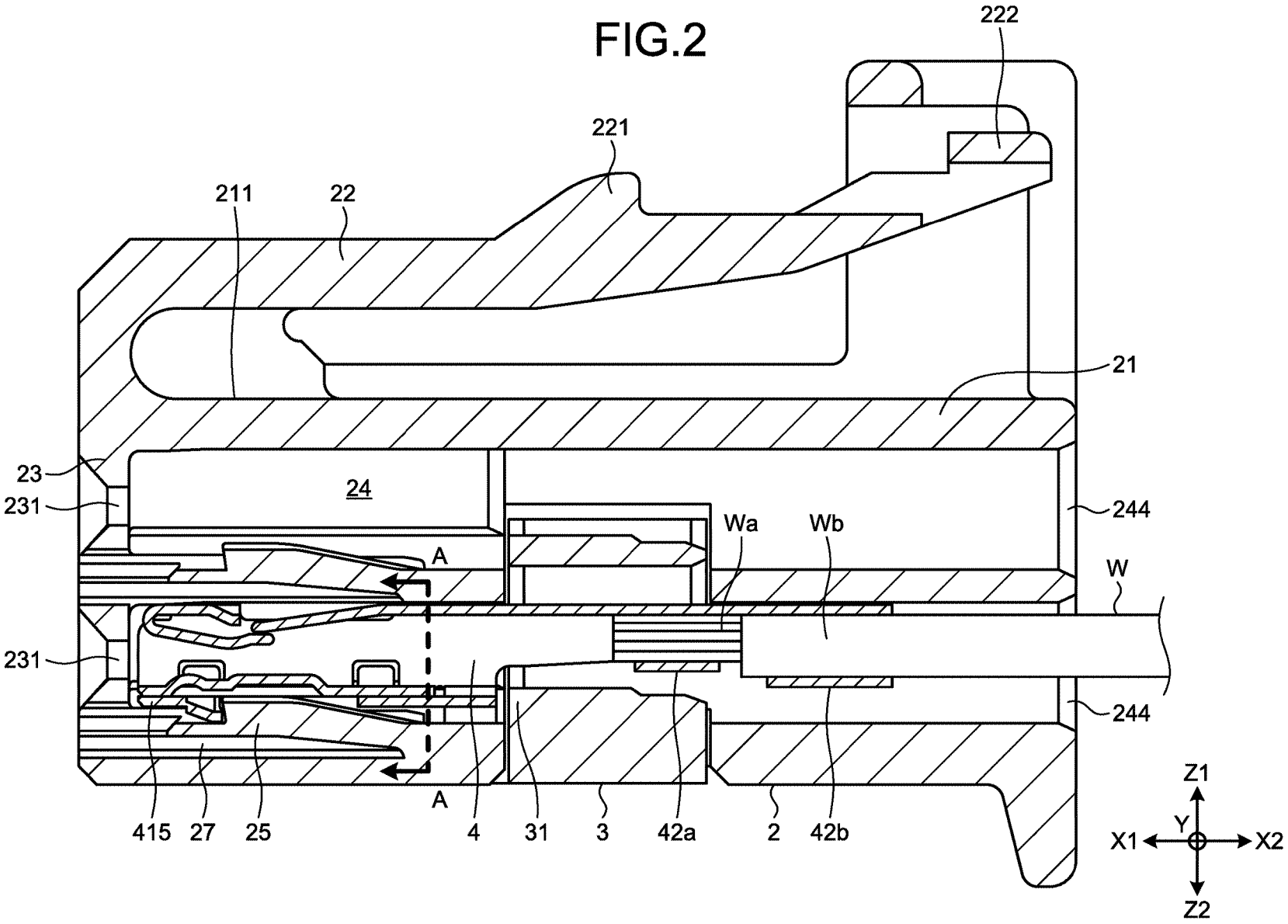
FIG. 2 is a cross-sectional view of the connector.
Figure 3:
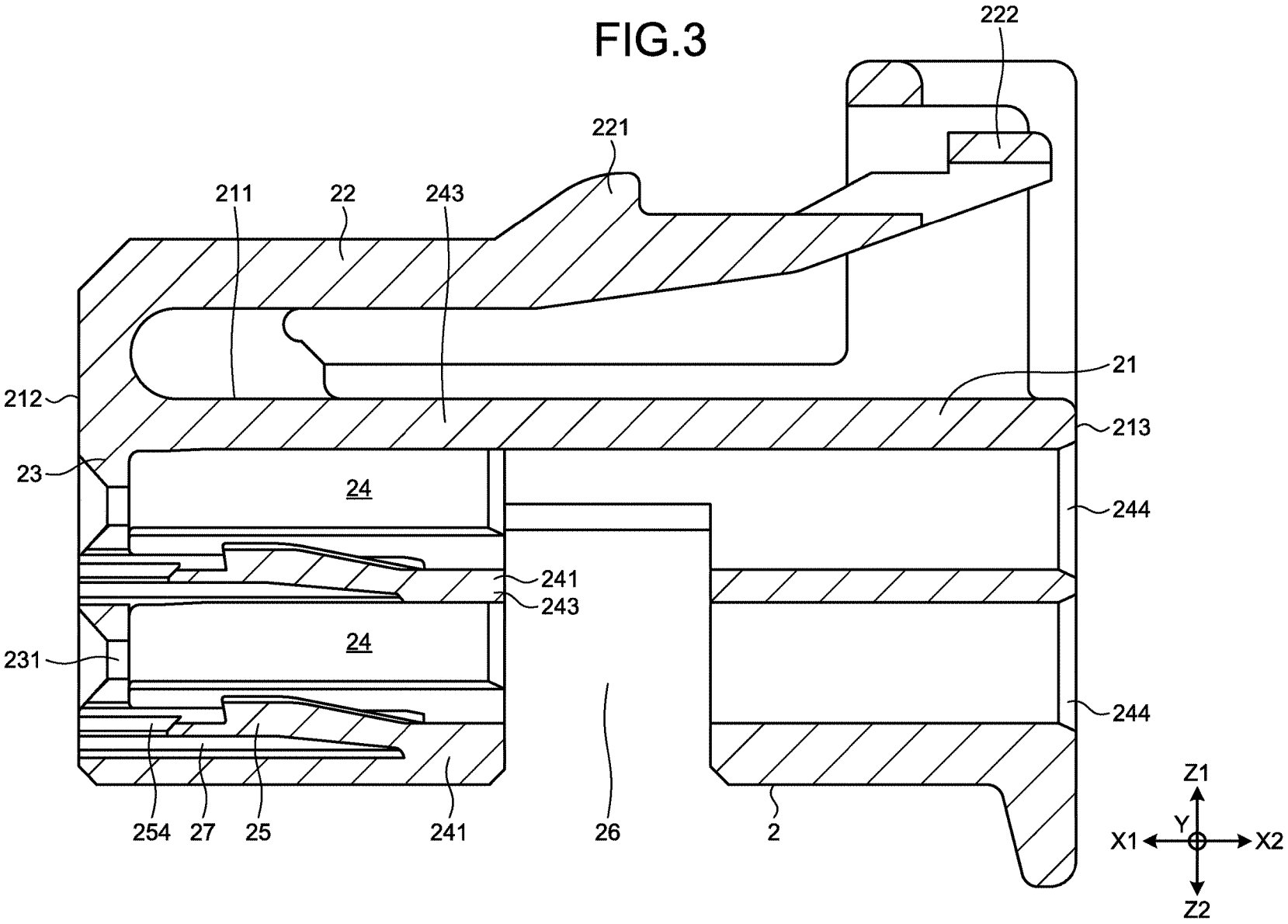
FIG. 3 is a cross-sectional view of a housing of the connector.
Figure 4:
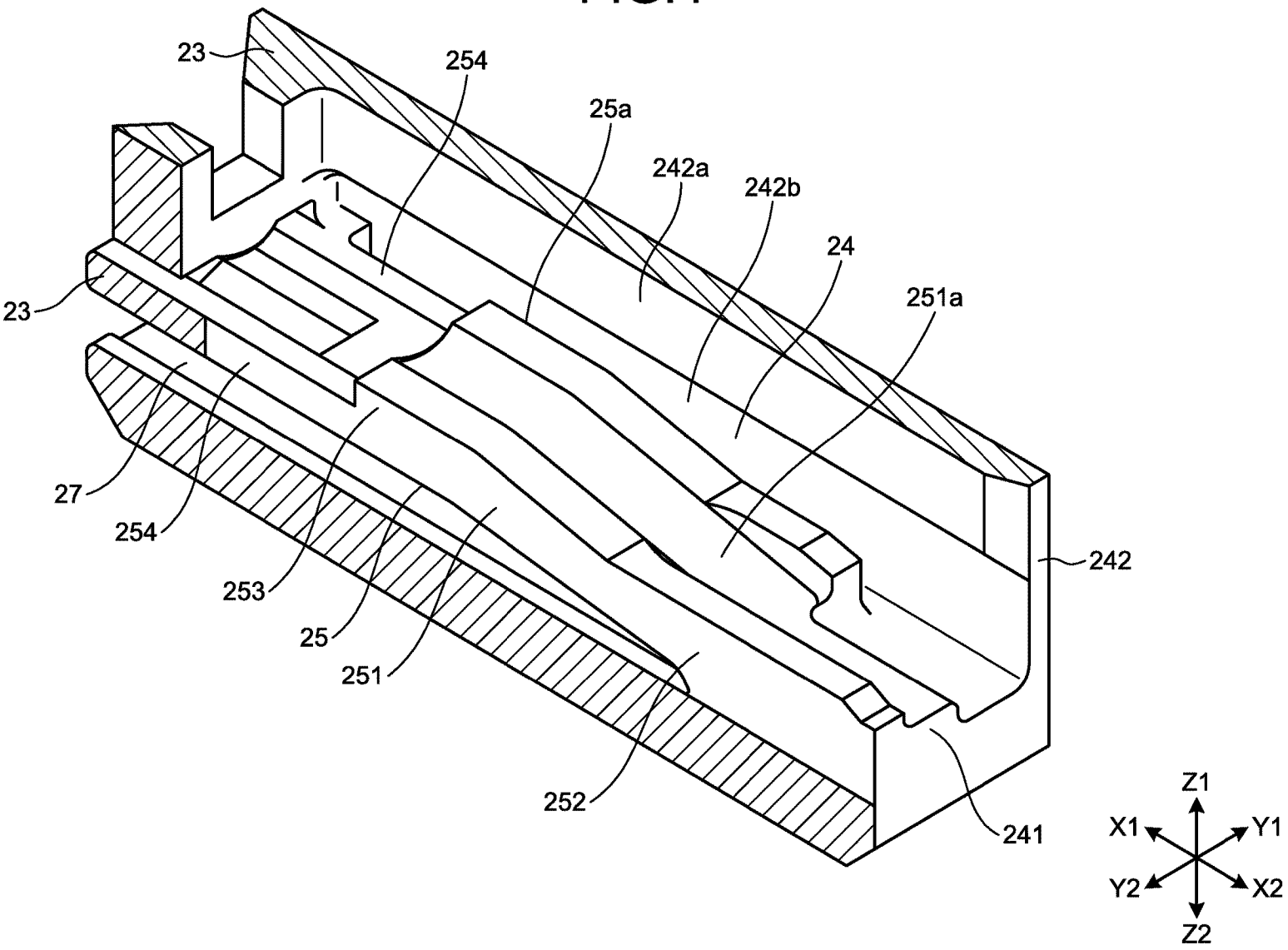
FIG. 4 is a partial cross-sectional perspective view of a terminal accommodating chamber of FIG. 3 as viewed from a rearward direction side.
Figure 5:
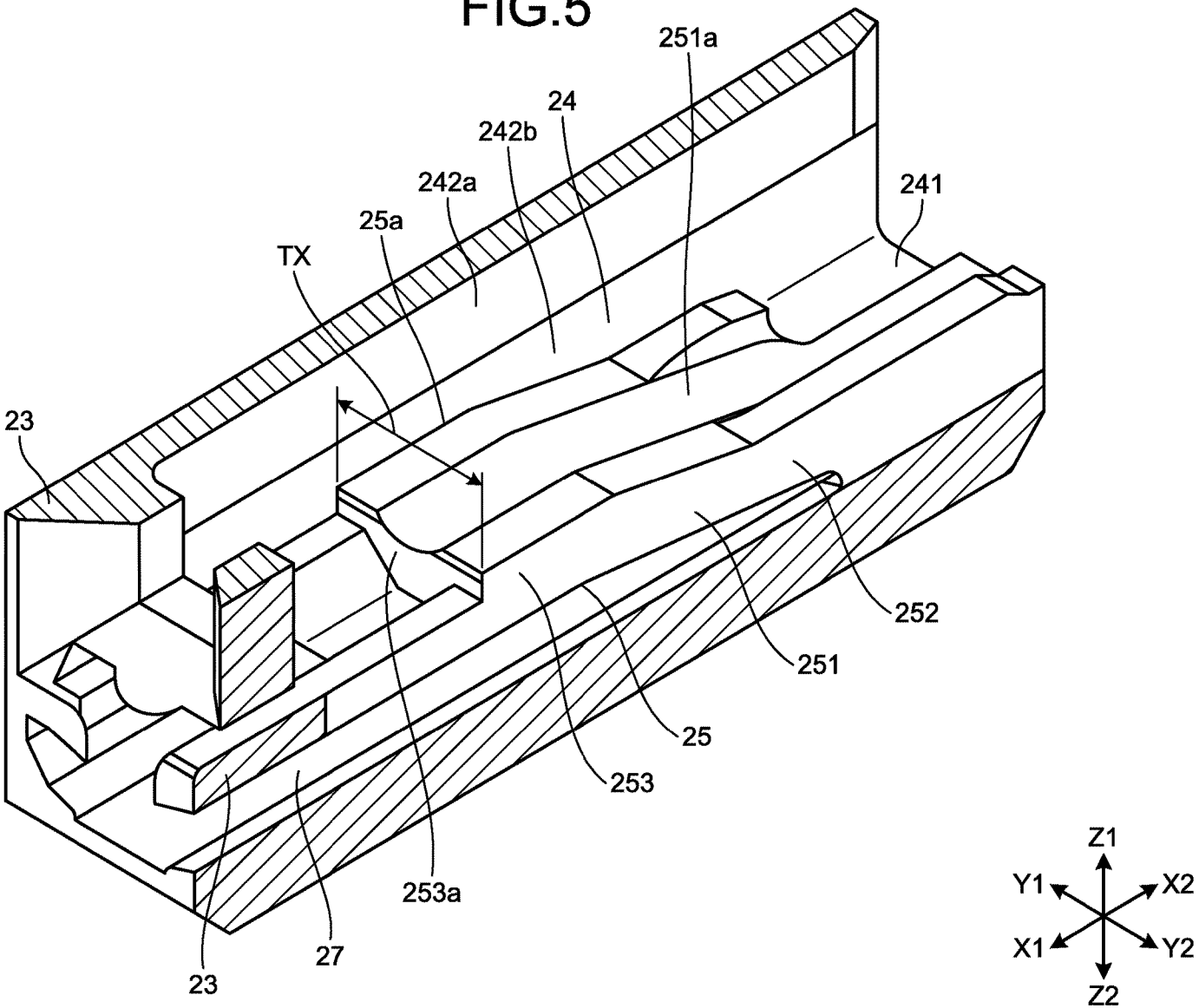
FIG. 5 is a partial cross-sectional perspective view of the terminal accommodating chamber of FIG. 3 as viewed from a forward direction side.
Figure 6:
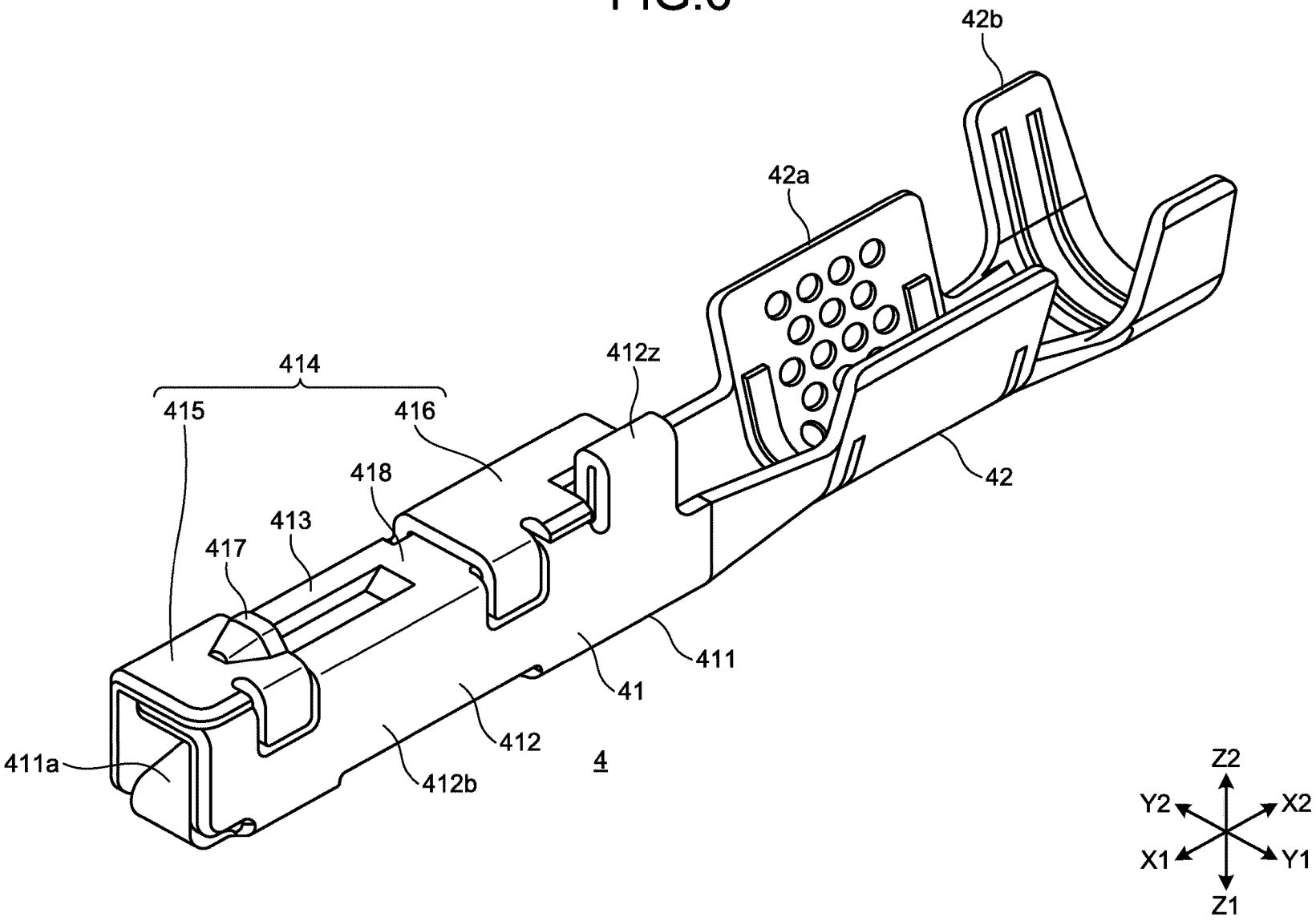
FIG. 6 is a perspective view of the terminal as viewed from the front side.
Figure 7:
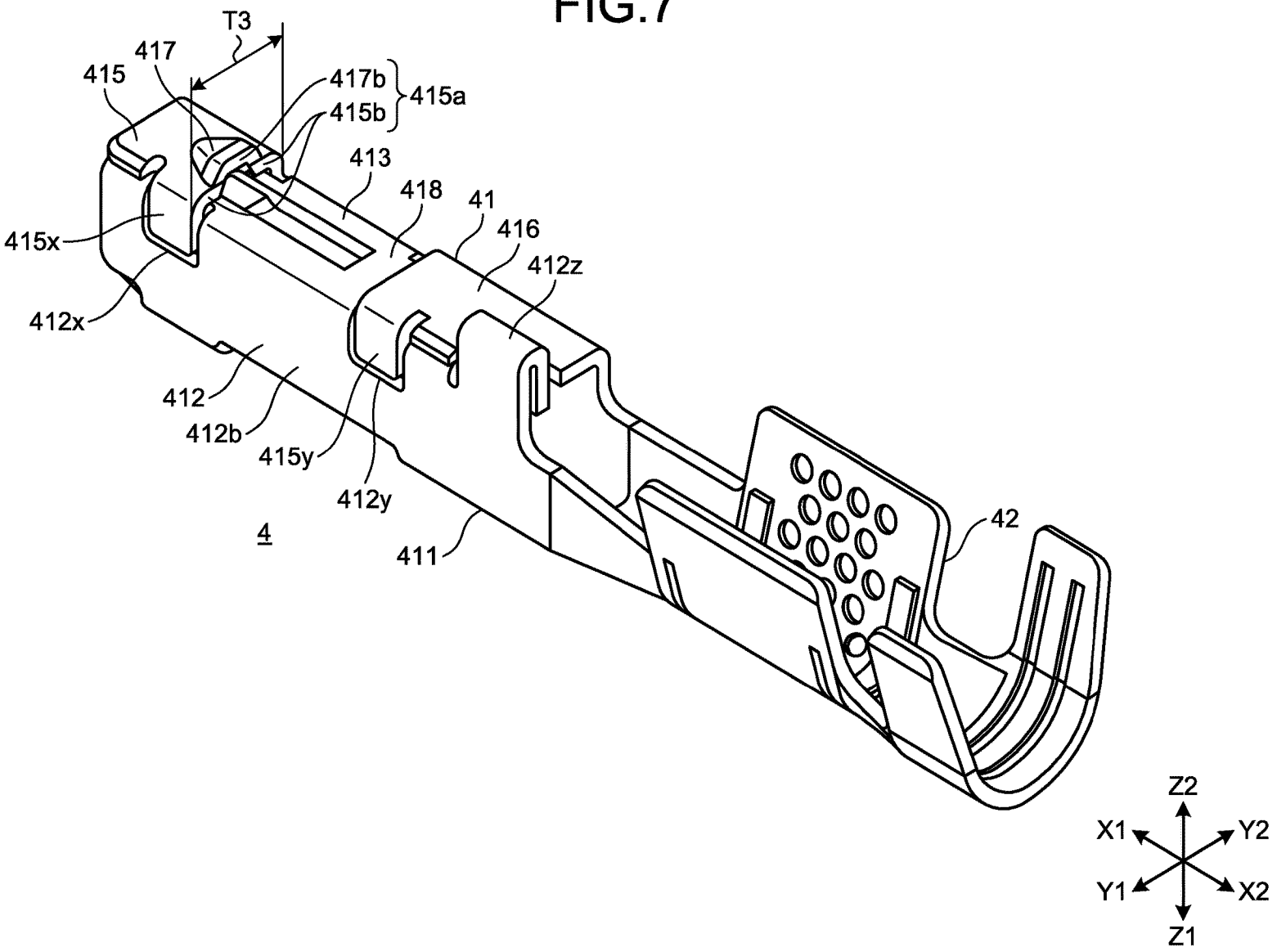
FIG. 7 is a perspective view of the terminal as viewed from the rear side.
Figure 8:
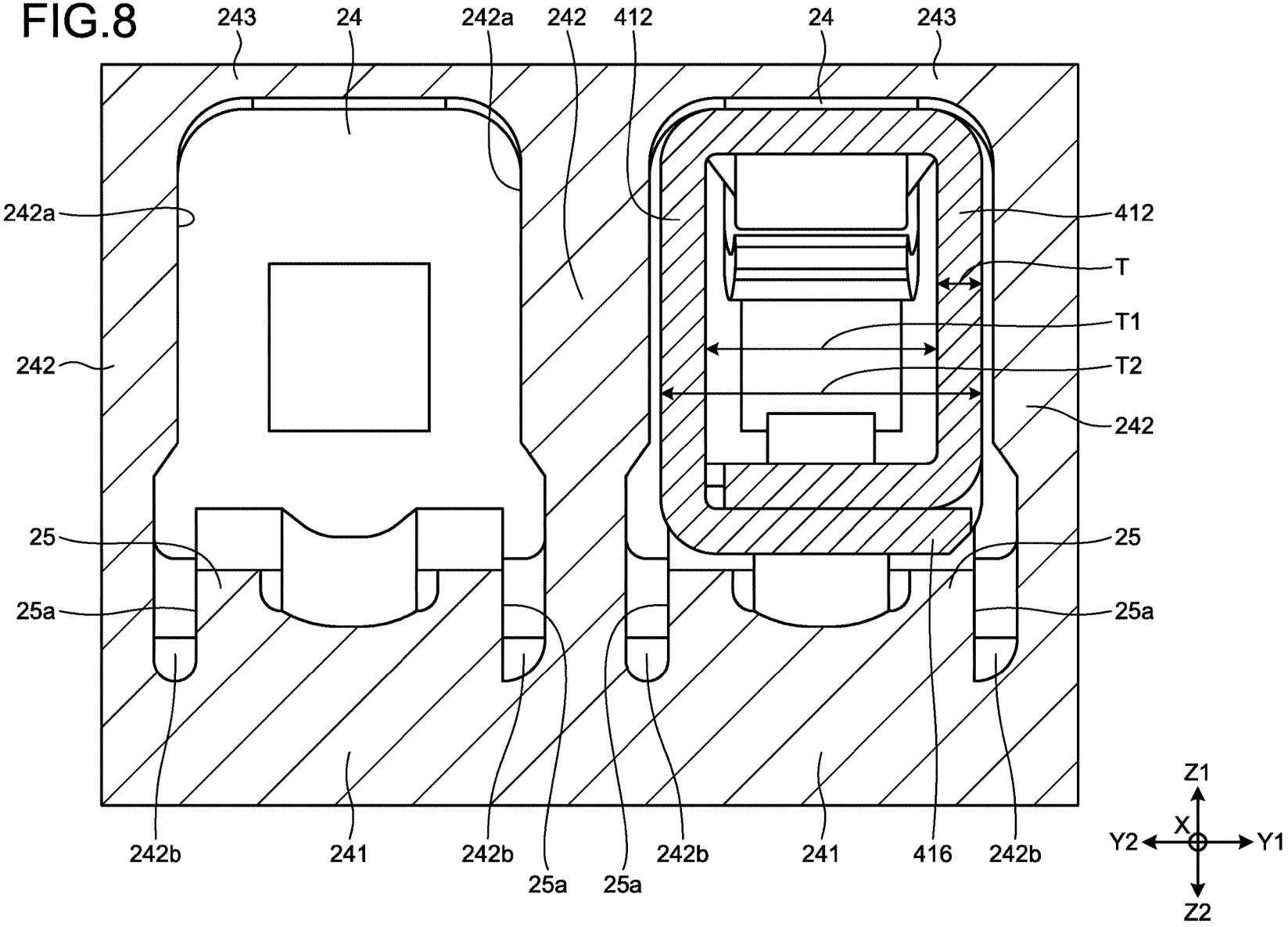
FIG. 8 is a partial cross-sectional view as viewed from a line A-A of FIG. 2.
Figure 9:
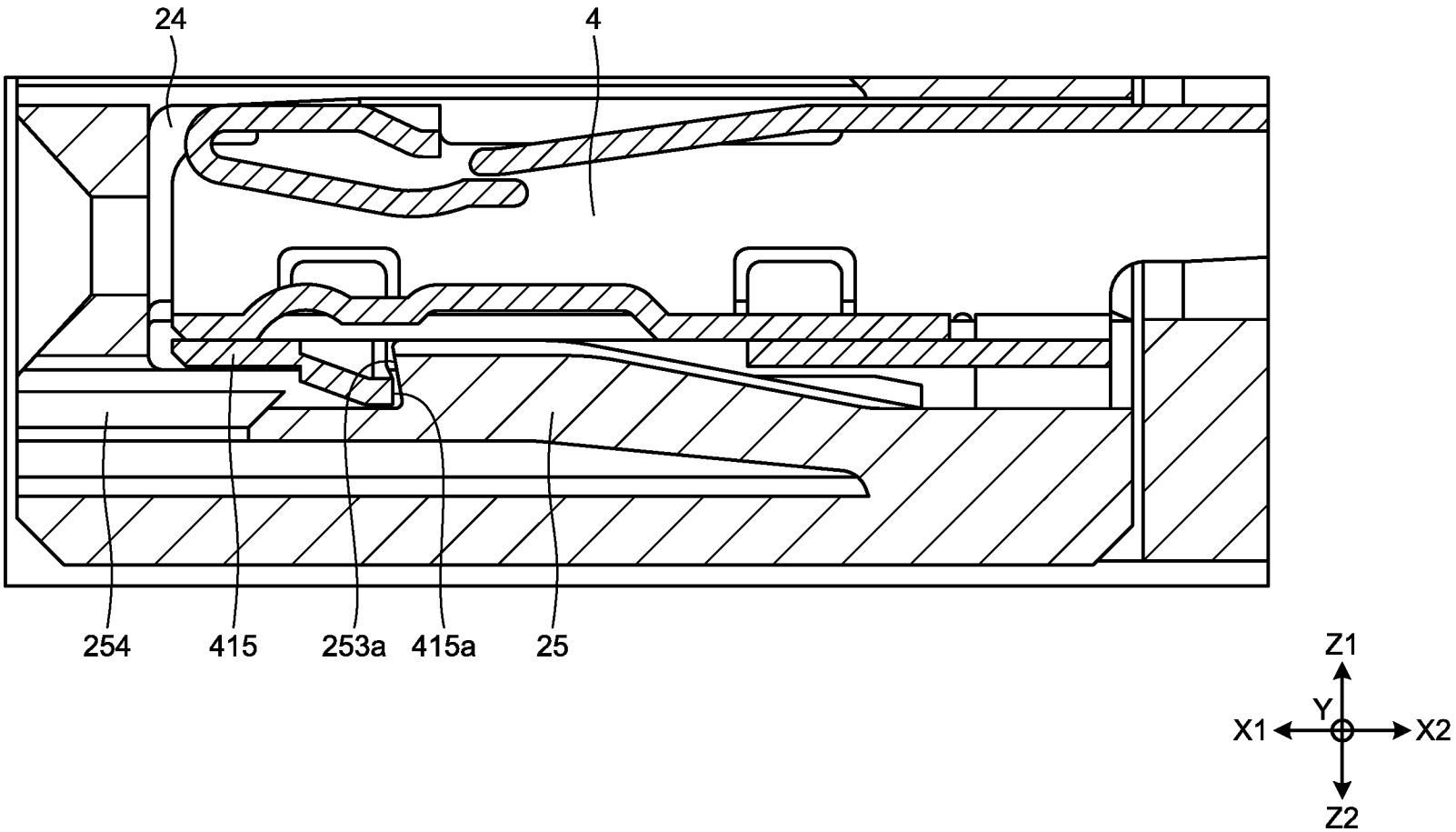
FIG. 9 is a partially enlarged view illustrating an engaged state of the terminal and a lance of FIG. 2.

A configuration of a connector according to an embodiment of the present invention will be described with reference to FIGS. 1 to 9. FIG. 1 is a perspective view illustrating a connector according to an embodiment of the present invention. FIG. 2 is a cross-sectional view of the connector. FIG. 3 is a cross-sectional view of a housing of the connector. FIG. 4 is a partial cross-sectional perspective view of a terminal accommodating chamber of FIG. 3 as viewed from a rearward direction X2 side. FIG. 5 is a partial cross-sectional perspective view of the terminal accommodating chamber of FIG. 3 as viewed from a forward direction X1 side. FIG. 6 is a perspective view of the terminal as viewed from the forward direction side. FIG. 7 is a perspective view of the terminal as viewed from the rearward direction side. FIG. 8 is a partial cross-sectional view as viewed from a line A-A of FIG. 2. FIG. 9 is a partially enlarged view illustrating an engaged state of the terminal and a lance of FIG. 2. Further, in FIG. 1, an electric wire W is not illustrated. In the drawings, X represents a front-rear direction of a connector 1, and X1 represents a forward direction and also represents an inserting direction of a terminal 4 with respect to a housing 2. X2 represents a rearward direction and also represents a detaching direction of the terminal 4 from the housing 2. Y represents a width direction of the connector 1, Y1 represents a left direction, and Y2 represents a right direction. Z represents a height direction, Z1 represents an upward direction, and Z2 represents a downward direction. In addition, X, Y, and Z are directions orthogonal to each other.

As illustrated in FIGS. 1 and 2, the connector 1 according to the present embodiment includes the housing 2, the terminal 4 to which an electric wire W is connected, and a side spacer 3. Further, the connector 1 is a female type connector in which the female type terminal 4 is accommodated.

As illustrated in FIGS. 1 and 3, the housing 2 is injection-molded with a mold by insulating synthetic resin, and has a housing main body 21 and a lock arm 22. The housing main body 21 has a rectangular parallelepiped shape having a rectangular cross section in a direction orthogonal to the front-rear direction X. The housing main body 21 has an insertion space 26 in which the side spacer 3 is mounted in the middle in the front-rear direction X. The forward direction X1 side of the lock arm 22 is connected to an upper surface 211 of the housing main body 21, and the lock arm 22 is formed in a cantilever beam shape which is elastically deformable in the height direction Z. The lock arm 22 has a lock protrusion 221 that engages with a mating connector (not illustrated) in the middle in the front-rear direction X, and has a manipulation unit 222 which releases the engaged state with the mating connector (not illustrated) on the rearward direction X2 side.

As illustrated in FIGS. 1 and 3, the housing 2 has a plurality of tab insertion holes 231 on the forward direction X1 side of the housing main body 21. The plurality of tab insertion holes 231 has the same shape. The tab insertion hole 231 penetrates in the rearward direction X2 from a front face 212 of a front wall 23 located in the forward direction X1, and a tab of a mating connector (not illustrated) is inserted into the tab insertion hole 231. Further, in this embodiment, 2×13=26 (pieces) tab insertion holes 231 are provided.

As illustrated in FIGS. 3 and 8, the housing main body 21 has a plurality of terminal accommodating chambers 24. The plurality of terminal accommodating chambers 24 has the same shape. The terminal accommodating chamber 24 has a rectangular cross section in a direction orthogonal to the front-rear direction X, and is molded in a rectangular parallelepiped shape. The terminal accommodating chamber 24 is molded from a front wall 23, an upper wall 243, two facing walls 242, 242, and a bottom wall 241. The upper wall 243 and the bottom wall 241 face each other in the height direction Z. The two facing walls 242, 242 face each other in the width direction Y. The bottom wall 241 has an elastically deformable lance 25 connected by a base portion 252 to be described later. The tab insertion hole 231 and the terminal accommodating chamber 24 are continuous spaces in the front-rear direction X. The rearward direction X2 side of the terminal accommodating chamber 24 is an opening 244 on a rear face 213. Further, in this embodiment, 2×13=26 (pieces) of terminal accommodating chambers 24 are provided. Also, in this embodiment, as illustrated in FIG. 3, in the height direction Z, the upper wall 243 defining the terminal accommodating chamber 24 on the downward direction Z2 side also serves as a bottom wall 241 which defines the terminal accommodating chamber 24 on the upward direction Z1 side.

As illustrated in FIGS. 4, 5, and 8, the two facing walls 242, 242 of the terminal accommodating chamber 24 have grooves 242*b*, 242*b* which are recessed in the left direction Y1 and the right direction Y2 (the outer side in the width direction Y) from respective facing wall inner faces 242*a*, 242*a*. The grooves 242*b*, 242*b* face lance side faces 25*a*, 25*a* of a lance 25 to be described later in the width direction Y, and are molded along the front-rear direction X.

As illustrated in FIGS. 4 and 5, the lance 25 has a lance main body 251 and connecting arms 254, 254, and has a shape of a double-supported beam which is elastically deformable in the height direction Z. In the lance main body 251, a base portion 252 on the rearward direction X2 side is connected to the bottom wall 241, and the forward direction X1 side is connected to the front wall 23 via the connecting arms 254, 254. The lance main body 251 has a locking unit 253, and a guide groove 251*a* located on the upward direction Z1 side and extending in the front-rear direction X. The locking unit 253 of the lance 25 has a locking face 253*a* facing the forward direction X1 side which is the inserting direction of the terminal.

Here, as illustrated in FIG. 5, the width of the locking face 253*a* in the width direction Y is defined as a "locking face width TX".

On the downward direction Z2 side of the lance 25, a deflection space 27 is provided to be adjacent to the lance 25. The deflection space 27 is molded as a space passing through the front wall 23 and reaching the front face 212, from the base portion 252 of the lance 25 toward the forward direction X1.

As illustrated in FIGS. 6 and 7, the terminal 4 is molded by punching or bending a conductive metal plate made of a metal material such as copper or a copper alloy, and has a box portion 41 and a connecting portion 42. The box portion 41 and the connecting portion 42 are connected to each other in the front-rear direction X and are united. Further, the terminal 4 is a female type terminal connected to a tab of a mating terminal (not illustrated).

The box portion 41 has a rectangular cross section in a direction orthogonal to the front-rear direction X, and is molded in a rectangular parallelepiped shape. The box portion 41 has a ceiling plate 414, an upper plate 413, two facing plates 412, 412, and a bottom plate 411. The upper plate 413 and the bottom plate 411 face each other in the height direction Z. The two facing plates 412, 412 face each other in the width direction Y. The ceiling plate 414 overlaps the downward direction Z2 side of the upper plate 413, and faces the bottom plate 411. The ceiling plate 414 is connected, on the downward direction Z2 side, to one facing plate 412, which is the right direction Y2 side among the two facing plates 412, 412, in the width direction Y. The upper plate 413 is connected, on the downward direction Z2 side, to the other facing plate 412 of the left direction Y1 side among the two facing plates 412, 412, in the width direction Y. The bottom plate 411 is connected to two facing plates on the upward direction Z1 side. Further, in the box portion 41, as illustrated in FIG. 6, an elastically deformable contact spring 411*a* which is folded back on the forward direction X1 side of the bottom plate 411 and extends in the rearward direction X2 is disposed.

The ceiling plate 414 has a front ceiling plate 415 located on the forward direction X1 side, and a rear ceiling plate 416 located on the rearward direction X2 side, which are molded by a notch 418 reaching respective facing plate outer faces 412*b*, 412*b* of the two facing plates 412, 412 in the middle in the front-rear direction X. The front ceiling plate 415 has a locking target face 415*a* facing the rearward direction X2 side which is the detaching direction of the terminal 4. The locking target face 415*a* reaches the respective facing plate outer faces 412*b*, 412*b* of the two facing plates 412, 412 in the width direction Y.

On the front ceiling plate 415, a convex portion 417 reaching the locking target face 415*a* is molded in the front-rear direction X to protrude toward the downward direction Z2. The convex portion 417 in this embodiment is molded in a substantially triangular pyramidal shape. The locking target face 415*a* of the front ceiling plate 415 has a horizontal locking target face portion 415*b*, and a convex locking target face portion 417*b* protruding in the downward direction Z2 by molding of the convex portion 417.

The front ceiling plate 415 has a front convex portion 415*x* which is connected to one facing plate 412 which is a right direction Y2 side among the two facing plates 412, 412 in the width direction Y, and protrudes from the other facing plate 412 side which is a left direction Y1 side toward the bottom plate 411 side. The end face of the front convex portion 415*x* on the rearward direction X2 side is flush with the horizontal locking target face portion 415*b* (see FIG. 7). The rear ceiling plate 416 has a rear convex portion 415*y* protruding toward the bottom plate 411 side from the other facing plate 412 side, which is the left direction Y1 side among the two facing plates 412, 412 in the width direction Y. Here, the other facing plate 412 has a front concave portion 412*x* and a rear concave portion 412*y* notched from the ceiling plate 414 side toward the bottom plate 411 side. The front concave portion 412*x* and the rear concave portion 412*y* are molded by partially notching the upper plate 413 and the other facing plate 412, from the bent portion of the upper plate 413 and the other facing plate 412. In a state in which the box portion 41 is bent, the front convex portion 415*x* and the front concave portion 412*x* are engaged with each other, and the rear convex portion 415*y* and the rear concave portion 412*y* are engaged with each other. The front convex portion 415*x* and the rear convex portion 415*y* are a part of the other facing plate 412. Further, the other facing plate 412 has a stabilizer 412*z* that protrudes toward the downward direction Z2 side, on the rearward direction X2 side.

Here, as illustrated in FIG. 8, a plate thickness of the facing plates 412, 412 in the width direction Y is defined as a "plate thickness T", an inner face width between the two facing plates 412, 412 is defined as a "both facing plate inner face width T1", and an outer face width between the two facing plates 412, 412 is defined as a "both facing plate outer face width T2". Further, as illustrated in FIG. 7, the width of the locking target face 415*a* is defined as a "locking target face width T3". In this embodiment, the both facing plate outer face width T2 is equal to the locking target face width T3 (T2=T3).

The connecting portion 42 has a core wire crimping piece 42*a* located on the forward direction X1 side, and a cover crimping piece 42*b* located on the rearward direction X2 side, in the front-rear direction X. The connecting portion 42 has a U-shaped cross section in a direction orthogonal to the front-rear direction X. In a state in which the electric wire W is connected to the connecting portion 42, a core wire Wa is caulked by the core wire crimping piece 42*a*, and a covering Wb is caulked to the cover crimping piece 42*b* (see FIG. 2). Further, the core wire Wa is molded from a metal material such as copper or a copper alloy or aluminum or an aluminum alloy.

Here, assembly of the connector 1 will be described. In a state before the terminal 4 is inserted into the terminal accommodating chamber 24, the side spacer 3 is inserted into the insertion space 26 of the housing main body 21 and temporarily locked by a temporary locking unit (not illustrated). Next, insertion of the terminal 4 is started by inserting the terminal 4 toward the forward direction X1 from the opening 244 of the terminal accommodating chamber 24. In the process of inserting the terminal 4, the convex portion 417 of the terminal 4 elastically deforms the lance 25 toward the deflection space 27 on the downward direction Z2 side, while sliding on the guide groove 251*a* of the lance 25. When the terminal 4 is accommodated in the predetermined position of the terminal accommodating chamber 24, the convex portion 417 slides on the guide groove 251*a*, and the lance 25 returns to the original state by the restoring force. When the lance 25 returns to the original state, the locking face 253*a* of the lance 25 engages with the locking target face 415*a* of the terminal 4. Finally, the side spacer 3 is moved in the upward direction Z1 from the temporary locking position, and is fully locked by a main locking unit (not illustrated) (see FIG. 2). In the main locking state of the side spacer 3, a double locking unit 31 of the side spacer 3 engages with the rear ceiling plate 416 of the terminal 4, the facing plates 412, 412, and the end face on the rearward direction X2 side of the stabilizer 412*z*. The terminal 4 is engaged with the lance 25 by the side spacer 3 at two positions.

Next, the engaged state between the terminal 4 and the lance 25 will be described. Since the locking target face width T3 of the locking target face 415*a* of the terminal 4 is equal to the both facing plate outer face width T2, the locking target face width T3 is the sum of the both facing plate inner face width T1 and the plate thickness T (T3=T2=T1+2×T). The locking face width TX of the locking face 253*a* of the lance 25 is set to be wider than the both facing plate inner face width T1 and to be slightly narrower than the locking target face width T3 (TI<TX<T3). When the terminal 4 is accommodated in the terminal accommodating chamber 24, the locking face 253*a* of the lance 25 engages with the locking target face 415*a* of the terminal 4 in a range (a width dimension) wider than the both facing plate inner face width T1 of the two facing plates 412, 412 in the width direction Y. As a result, an engaging area between the locking face 253*a* and the locking target face 415*a* is also widened. Therefore, even when a tensile force in the rearward direction X2 is applied to the electric wire W connected to the terminal 4, the lance 25 is hard to be sheared, and the holding force of the terminal 4 is improved.

In addition, since the convex portion 417 is molded on the front ceiling plate 415, the locking target face 415*a* has not only the horizontal locking target face portion 415*b*, but also the convex locking target face portion 417*b* that protrudes in the downward direction Z2 by molding of the convex portion 417. Therefore, an engaging range of the locking face 253*a* of the lance 25 is widened in the height direction Z by the convex locking target face portion 417*b*, and is dispersed in the downward direction Z2. As a result, the locking face 253*a* is engaged with the locking target face 415*a* in a state in which the engaging range is widened in the height direction Z. Therefore, even when a tensile force in the rearward direction X2 is applied to the electric wire W connected to the terminal 4, the lance 25 is hard to be sheared, and the holding force of the terminal 4 is further improved.

When the terminal 4 is accommodated in the terminal accommodating chamber 24 in a state in which the front convex portion 415*x* of the front ceiling plate 415 is engaged with the front concave portion 412*x* of the other facing plate 412, the locking face 253*a* of the lance 25 engages with the locking target face 415*a* of the terminal 4. Therefore, even when the tensile force in the rearward direction X2 is applied to the electric wire W connected to the terminal 4, the front ceiling plate 415 is hard to be deformed and the strength is improved. Further, even when an external force is applied to the terminal 4 at the time of conveying the terminal 4 or the like, the front ceiling plate 415 is hard to be deformed.

Here, a relation between the terminal accommodating chamber 24 and the lance 25 will be described. In the injection molding of the housing 2, a metal mold separated in the front-rear direction X is used. In order to mold the elastically deformable lance 25 in the terminal accommodating chamber 24, it is necessary to provide a gap corresponding to a pin of the metal mold, between the lance side faces 25*a*, 25*a* and the facing wall inner faces 242*a*, 242*a* of the facing walls 242, 242, in the width direction. It is necessary to set a width of the pin in consideration of the strength of the pin so that the pin does not break at the time of injection molding. When it is attempted to set the widths of the lance side faces 25*a*, 25*a* and the facing wall inner faces 242*a*, 242*a* to be wide in consideration of the strength of the pin, the width of the lance itself becomes narrow and the strength of the lance weakens.

The grooves 242*b*, 242*b* of the two facing walls 242, 242 are molded along the front-rear direction X in the portions facing the lance side faces 25*a*, 25*a*. By the grooves 242*b*, 242*b*, the lance side faces 25*a*, 25*a* are displaced in the left direction Y1 and the right direction Y2 (outside in the width direction Y), respectively, and a gap in which the strength of the pin is secured is provided between the lance side faces 25*a*, 25*a* and the surfaces of the grooves 242*b*, 242*b*. Therefore, the width of the lance 25 can be set to be wider, while securing the strength of the pin of the metal mold, and the strength of the lance 25 itself can be increased. In addition, since the width of the lance 25 can be set to be wider, the locking face width TX can also be widened. Therefore, even when a tensile force in the rearward direction X2 is applied to the electric wire W connected to the terminal 4, the lance 25 is hard to be sheared, and the holding force of the terminal 4 is further improved.

In the lance main body 251 of the lance 25, the base portion 252 on the rearward direction X2 side is connected to the bottom wall 241, and the forward direction X1 side is connected to the front wall 23 via the connecting arms 254, 254. Therefore, even when a tensile force in the rearward direction X2 is applied to the electric wire W connected to the terminal 4, the holding force of the terminal 4 is further improved by the connecting arms 254, 254. Further, the connecting arms 254, 254 prevent rattling of the terminal 4 in the terminal accommodating chamber 24 by coming into contact with (pressed) the front ceiling plate 415 of the terminal 4.

In the aforementioned embodiment, the female type connector 1 that accommodates the female type terminal 4 is used, but a male type connector that accommodates a male type terminal may be used. In this case, a box portion is provided between the tab and the connecting portion in the male type terminal.

In the above-described embodiment, the lance 25 is in the form of a double-supported beam by the connecting arms 254, 254, but may be in the form of a cantilever beam having no connecting arm.

In the aforementioned embodiment, the locking target face 415*a* of the front ceiling plate 415 has the convex locking target face portion 417*b* by molding of the substantially triangular pyramidal convex portion 417, but the convex portion may have a rectangular tube shape, a cylindrical shape, a conical shape, or the like. In addition, although the convex portion 417 protrudes toward the downward direction Z2 side, it may protrude in the upward direction Z1.

In the aforementioned embodiment, the locking face width TX of the locking face 253*a* of the lance 25 is set to a dimension that is wider than the both facing plate inner face width T1 and slightly narrower than the locking target face width T3 (TI<TX<T3). By adjusting the depths of the recesses of the grooves 242*b*, 242*b* in the left direction Y1 and the right direction Y2 (the outer side in the width direction Y), the lance side faces 25*a*, 25*a* may be located at the same position as the facing wall inner faces 242*a*, 242*a* and the depth range of the grooves, and the locking face width TX may be set to a dimension which is equal to or wider than the locking target face width T3 (T3≤TX).

The connector according to the present embodiment has an effect that is capable of improving the holding force of the terminal accommodated in the terminal accommodating chamber of the housing.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal that is connected to an electric wire; and a housing, wherein the housing has a housing main body, the housing main body has a terminal accommodating chamber, the terminal accommodating chamber has a rectangular cross section in a direction orthogonal to a front-rear direction, the terminal accommodating chamber is molded from a front wall, an upper wall, two facing walls, and a bottom wall, the upper wall and the bottom wall face each other in a vertical direction orthogonal to the front-rear direction, the two facing walls face each other in a width direction orthogonal to the front-rear direction and the vertical direction, the bottom wall has an elastically deformable lance connected at a base portion, the lance has a locking face facing a forward direction side which is an inserting direction of the terminal, the terminal has a box portion and a connecting portion, the box portion has a rectangular cross section in a direction orthogonal to the front-rear direction, the box portion has a ceiling plate, two facing plates, and a bottom plate, the ceiling plate and the bottom plate face each other in the vertical direction, the two facing plates face each other in the width direction, the ceiling plate has at least a front ceiling plate molded by a notch reaching each facing plate outer face of the two facing plates, the front ceiling plate has a locking target face facing a rearward direction side which is a detaching direction of the terminal, in a state in which the terminal is accommodated in the terminal accommodating chamber, the locking face engages with the locking target face in a range wider than both facing plate inner face widths of the two facing plates in the width direction, the lance has a lance main body and connecting arms, and the lance main body has the locking face and the base portion, the base portion of the lance main body, on the rearward direction side, is connected to the bottom wall, and the lance main body, on the forward direction side, is connected to the front wall via the connecting arms, the connecting arms comprise a first connecting arm and a second connecting arm, the first connecting arm and the second connecting arm are arranged in rows at a first distance from each other in the width direction and are connected to a front end of the lance main body, a second distance between an outer edge of the first connecting arm, opposite to a side towards the second connecting arm, and an outer edge of the second connecting arm, opposite to a side towards the first connecting arm, is equal to a width of the locking face in the width direction, the two facing walls of the terminal accommodating chamber have grooves recessed outward in the width direction from each facing wall inner face, and the grooves face a lance side face and are molded along the front-rear direction from the front wall to an opening of the terminal accommodating chamber at the rearward direction side.

2. The connector according to claim 1, wherein the locking target face of the front ceiling plate has a horizontal locking target face portion, and a convex locking target face portion which protrudes in the vertical direction by molding of a convex portion reaching the locking target face on the front ceiling plate in the front-rear direction.

3. The connector according to claim 1, wherein the front ceiling plate has a front convex portion which is connected to one facing plate of the two facing plates in the width direction and protrudes from the other facing plate side toward the bottom plate side, the other facing plate has a front concave portion which is notched from the ceiling plate side toward the bottom plate side, and the front convex portion and the front concave portion engage with each other.

4. The connector according to claim 2, wherein the front ceiling plate has a front convex portion which is connected to one facing plate of the two facing plates in the width direction and protrudes from the other facing plate side toward the bottom plate side, the other facing plate has a front concave portion which is notched from the ceiling plate side toward the bottom plate side, and the front convex portion and the front concave portion engage with each other.

5. The connector according to claim 1, wherein the locking face overlaps the first connecting arm and the second connecting arm in the vertical direction, on a side towards the upper wall.

* * * * *